United States Patent [19]

Rubin

[11] 4,341,453

[45] Jul. 27, 1982

[54] PHOTOGRAPHIC FILM TYPE SENSOR

[75] Inventor: Barry P. Rubin, Maple Grove, Minn.

[73] Assignee: Pako Corporation, Minneapolis, Minn.

[21] Appl. No.: 261,040

[22] Filed: May 7, 1981

[51] Int. Cl.[3] ..... G03D 3/08

[52] U.S. Cl. ..... 354/298; 354/319; 250/560

[58] Field of Search ..... 354/21, 210, 298, 319, 354/320, 321, 322, 324; 134/64 P, 122 P, 56 R; 352/80, 171; 226/45; 250/560

[56] References Cited

U.S. PATENT DOCUMENTS

| | | | |
|---|---|---|---|
| 4,021,832 | 5/1977 | Krehbiel et al. | 354/298 |
| 4,057,817 | 11/1977 | Korb et al. | 354/298 |
| 4,222,657 | 9/1980 | Leuchter | 354/324 |
| 4,300,828 | 11/1981 | Kaufmann | 354/298 |

OTHER PUBLICATIONS

Eastman Kodak Company, "New Kodacolor Continuous Film Processor, Model 1635."

*Primary Examiner*—L. T. Hix
*Assistant Examiner*—Alan Mathews
*Attorney, Agent, or Firm*—Kinney, Lange, Braddock, Westman and Fairbairn

[57] ABSTRACT

An automatic replenisher control system for a photographic cine processor includes a film type sensor which identifies, by film type, the unprocessed film entering the processor. Replenishment of processor fluids is controlled as a function of the identified film type. The film type sensor includes an array of reflective infrared (IR) sensors which are positioned across a path of the film. Each infrared sensor provides a sensor signal indicative of whether the film is adjacent the infrared sensor. Signal processing circuitry, including a digital computer, first determines the width of the film by sampling the signals from the infrared sensors a series of times, and totalling the number of sensor signals indicating the film is adjacent the sensor. 110 format film and large format films (such as 46 mm, 120/220 and 70 mm format films), are identified solely on the basis of width. A perforation sensing routine is performed to distinguish between leader, 126 format film and 135 format film. The perforation sensing is performed by reading the output signals of selected IR sensors and determining the presence of perforations along each edge of the film.

17 Claims, 6 Drawing Figures

PHOTOGRAPHIC FILM TYPE SENSOR

BACKGROUND OF THE INVENTION

1. Field of the Invention

The present invention relates to photographic film processing equipment. In particular, the present invention is a photographic film type sensor system for determining the type of film entering a photographic cine processor.

2. Description of the Prior Art

In the photofinishing industry, cine processor machines are used to continuously develop long webs of photographic film. Typically, several different sizes or formats of photographic film may be processed by the same cine processor. For example, in certain processors 110, 126 and 135 format film are processed. Other processors are capable of processing these three film formats as well as 46 mm, 120/220 and 70 mm format films.

In the prior art, cine processors typically have used flowmeters to control chemical replenishment of processor fluids. An operator has been required to manually adjust these flowmeters each time a new film type or film leader enters the cine processor. In general, therefore, the users of cine processors have been very dependent upon the skill of their operators for making accurate replenishment adjustments and, more importantly, for remembering to make the adjustments each time a new film type or film leader enters the processor.

As the processes and chemicals used to develop photographic film have continually been improved, the chemicals used for replenishment have become more concentrated. As a result, the margin for error in replenishment has decreased. Automatic replenishment of processor fluids in cine processors has become, therefore, very attractive.

In order to properly control replenishment in a cine processor on an automatic basis, an automatic replenishment control system requires information as to whether leader or photographic film is entering the processor, and (if film is entering) the particular film type or format. If leader is being run through the cine processor, replenishment is not required. In the case of the various film types, each requires a different replenishment rate.

U.S. Pat. No. 4,222,657 by Leuchter describes a cine processor having a set of pneumatic sensors which sense and identify 110, 126 and 135 film formats. The pneumatic sensors are in the form of air nozzles arranged on one side of the film web, and a corresponding set of pressure air-operated switches on the other side of the web opposite the respective air nozzles. The pneumatic sensors identify the 110, 126 and 135 format films by sensing the perforations which are unique to these different film types.

The Model 1635 Kodacolor Continuous Film Processor by Eastman Kodak Company featured a film size detector which sensed both film width and format. The film size detector formed part of a system which controlled positive displacement replenishment pumps so that the proper amount of replenisher was supplied for the film size being processed. The Model 1635 processor accepted only 110, 126 and 135 film formats. The film size detector was a transmissive infrared detector having light-emitting diodes on one side of the film and corresponding infrared sensors on the opposite side of the film.

Another film type sensor which has been available in the prior art is the Photomatic Film Type Sensor, which has a U-shaped bracket which guides the film between three infrared sources and three infrared sensors. This film type sensor is also limited to 110, 126 and 135 film formats, and utilizes transmissive IR sensing to identify these three film types and film leader.

There is a continuing need for improved photographic film type sensors which are accurate, simple in construction, and which are capable of sensing a wide variety of different film formats, including not only 110, 126 and 135 film formats, but also 46 mm, 120/220 and 70 mm film formats.

SUMMARY OF THE INVENTION

The film type sensor of the present invention identifies unprocessed film entering a cine processor based upon signals from an array of reflective infrared sensors which are positioned across a path of the film. Each infrared sensor provides a sensor signal which indicates whether the film is adjacent that particular reflective infrared sensor.

Signal processing circuitry first determines the width of the film by sampling the signals from the infrared sensors during each of a plurality of width determining cycles. The width is determined by counting the number of sensors of the array which have sensed presence of the film during each cycle. Certain film types, (for example, 110 format film), are identified solely on the basis of this width determination. If the width determination indicates that the film has a 35 mm width, a subsequent perforation sensing procedure is performed using signals from selected reflective infrared sensors of the array. By reading the output of signals of selected infrared sensors during a series of perforation sensing cycles and determining whether perforations are present along each edge of the film, the signal processing circuitry distinguishes between film leader, 126 format film, and 135 format film.

DETAILED DESCRIPTION OF THE PREFERRED EMBODIMENTS

Figure 1:
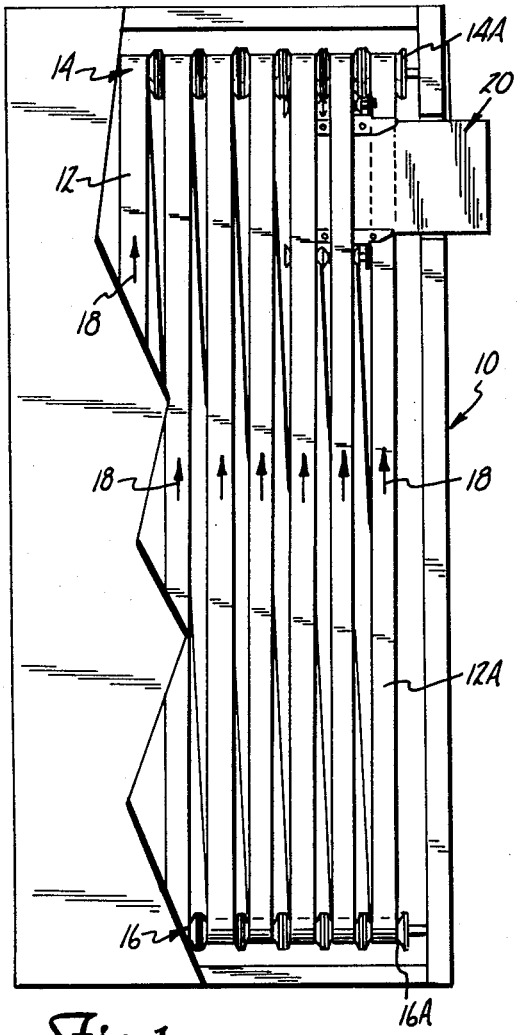
FIG. 1 is a front plan view of a loader/accumulator of a cine processor with the photographic film type sensor of the present invention positioned to sense film type as the film is about to enter the cine processor.

FIG. 1 shows a front view of loader/accumulator 10 of a cine processor. Film web 12 to be processed in the cine processor is fed from a supply reel (not shown) into loader/accumulator 10. Web 12 is fed in a serpentine path through loader/accumulator 10 before entering the processing tanks of the cine processor. Loader/accumulator 10 has a fixed set of upper rollers 14 and a vertically movable set of lower rollers 16 between which web 12 is driven. Lower rollers 16 change position vertically to accomodate variations in the input velocity of web 12 and to provide web 12 with an essentially constant velocity as it enters the cine processor. In the embodiment shown in FIG. 1, web 12 moves generally left-to-right, with the strands of web 12 which are on the front side in the FIG. 1 traveling upward, as illustrated by arrows 18. Final strand 12A of web 12 travels upward from final lower roller 16A and exits loader/accumulator 10 after passing over final upper roller 14A at the right end of the set of upper rollers 14.

Figure 3:
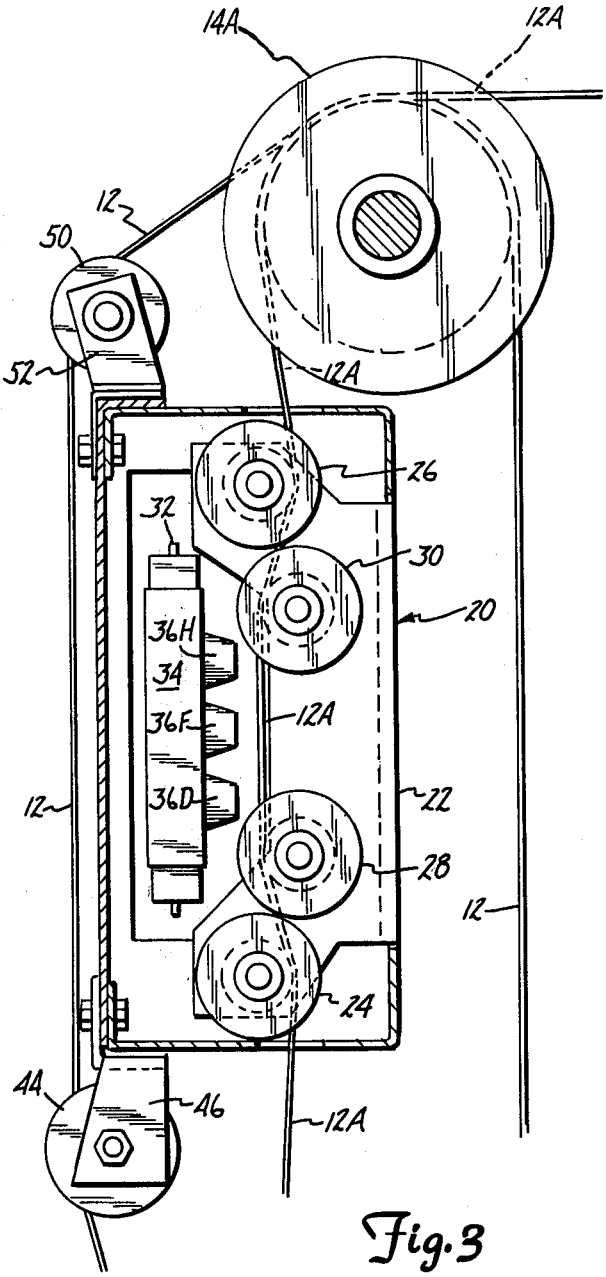
FIG. 3 is a sectional view along section 3—3 of FIG. 2.
Figure 2:
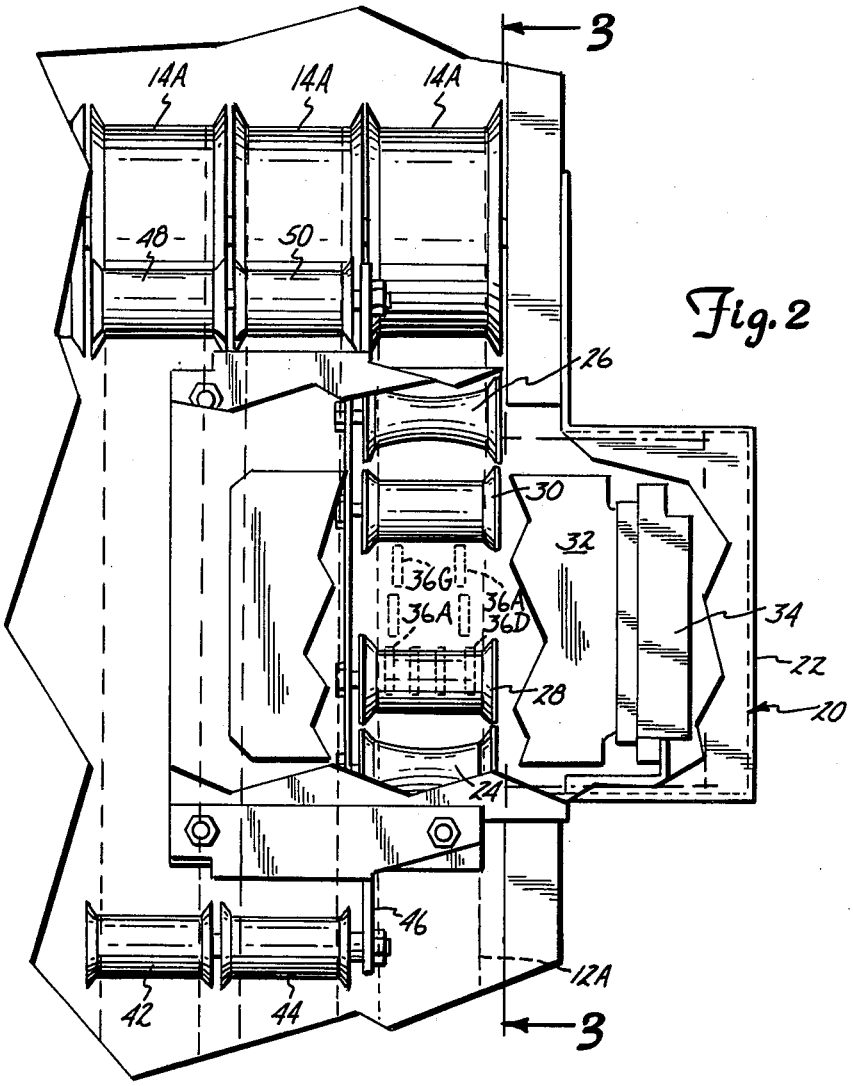
FIG. 2 is a front view, with portions broken away, of the film type sensor shown in FIG. 1.

Mounted near the upper right-hand corner of loader-/accumulator 10 is film width sensing unit 20. As shown in FIGS. 1–3, sensing unit 20 is positioned to sense the width of final strand 12A of web 12, just before strand 12A passes over final upper roller 14A and enters the cine processor. The position of sensing unit 20 assures that film tension is present on strand 12A to stabilize the film plane of web 12A. In addition, final strand 12A moves at an essentially constant velocity, since it is exiting loader/accumulator 10 and entering the processor. The helix angle that is present as final strand 12A travels upward from final lower roller 16A to final upper roller 14A provides a constant left edge location of strand 12A regardless of the width of the film web 12.

As shown in FIGS. 2 and 3, sensing unit 20 includes housing 22, through which film strand 12A is guided by hourglass rollers 24 and 26 and soft-touch rollers 28 and 30. Mounted within housing 20 is printed circuit board 32, which is inserted into terminal connector 34. Printed circuit board 32 supports an array 36 of reflective IR modules. In the embodiment illustrated in FIGS. 2–4, array 36 consists of eight reflective IR sensor modules 36A–36H which are arranged in three rows. Each row is generally transverse to the direction of travel of film strand 12A. The lowermost row is formed by reflective sensors 36A–36D. The middle row is formed by sensors 36E and 36F. These two sensors are offset slightly in the transverse direction with respect to sensors 36A–36D. This provides sensing even in the event of slight misalignment or transverse wandering of strand 12A. Similarly, the uppermost row is formed by sensors 36G and 36H, which are slightly offset transversely with respect to the other sensors of array 36. The middle and uppermost rows of sensors provide redundancy and, in some embodiments of the present invention, are not required.

Figure 4:
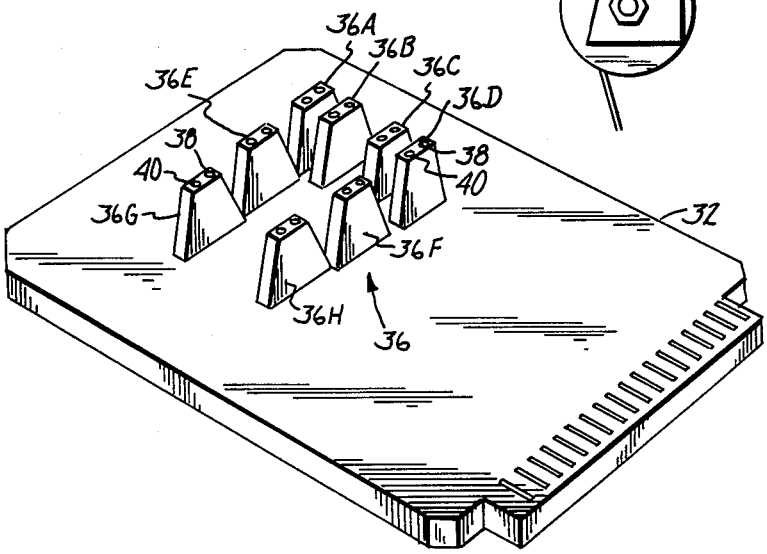
FIG. 4 is a perspective view of a printed circuit board with an array of reflective infrared sonsors for sensing 110, 126 and 135 format films.

Each of the sensor modules 36A–36H of array 36 includes an IR light emitting diode (LED) and an IR phototransistor (not shown) within a housing. As best shown in FIG. 4, each sensor module of array 36 has a pair of closely spaced holes 38 and 40. IR radiation is emitted from the LED through hole 38, and the phototransistor within the sensor module receives any reflected IR radition through hole 40. The Optron OPB 708 and Optek 8701 reflective IR assemblies are examples of reflective IR sensor modules which may be used as modules 36A–36H.

Figure 5:
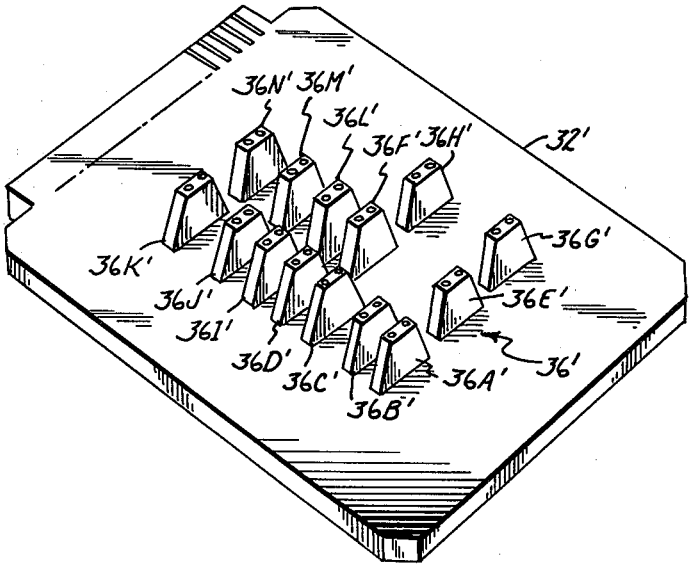
FIG. 5 is a perspective view of a printed circuit board with a reflective infrared sensor array used for sensing film types ranging from 110 format to 70 mm format.

The particular sensor array 36 shown in FIGS. 2–4 has been found to be useful in identifying 110, 136, and 135 film formats and in distinguishing film leader from photographic film. FIG. 5 illustrates circuit board 32' and sensor array 36' which has been found useful in detecting not only 110, 126 and 135 format films, but also other film formats such as 46 mm, 120/220, and 70 mm. As shown in FIG. 5, array 36' includes sensor modules 36A'–36H' (which are similar to sensor modules 36A–36H of array 36) and also includes additional sensor modles 36I'–36N'. Sensor modules 36I', 36J' and 36K' are aligned in the lowermost row with sensor modules 36A'–36D'. Sensor modules 36L'–36N' are aligned in the middle row with sensor modules 36E' and 36F', and provide redundancy in the event of malfunction of sensor modules 36I'–36K'.

An important advantage of the present invention is that by interchanging circuit board 32' for circuit board 32, film type sensing unit 20 is quickly and simply converted from identifying films with widths only up to 35 mm to identifying films with widths up to 70 mm. In some photofinishing operations, the cine processor is dedicated to processing only 110, 126 and 135 format films. In that case, the ability to send larger film widths is an unneeded and unnecessary capability and expense. The present invention accommodates the particular needs of the photofinisher simply by selection of circuit board 32 or 32'.

The present invention, therefore, permits the same film sensing assembly to be used for either application with a minimum of modification. Since all reflective sensor modules 36A–36H or 36A'–36N' are located on one side of the film, critical alignment adjustments of the IR transmitters and receivers are not required (as is the case with prior art transmissive IR sensors).

Array 36 (or 36') provides output signals based upon IR radiation reflected off the emulsion side of strand 12A. Because the intensity of reflected IR radiation varies with the distance between strand 12A and the sensor modules of array 36 (or 36') the distance between the film plane defined by strand 12A and the sensor plane defined by array 36 (or 36') must be kept constant. For example, in one preferred embodiment, a distance of 0.25 inch between the film plane and the sensor plane is maintained. In the preferred embodiment shown in FIGS. 1 through 3, the combination of hourglass rollers 24 and 26 and soft-touch rollers 28 and 30 provides the required constant position of the film plane without contacting the image area portion of the emulsion on strand 12A. The only contact with the emulsion side of strand 12A is by hourglass rollers 24 and 26, and this contact is only along the marginal edges of strand 12A.

As illustrated in FIGS. 1 through 3, sensing unit 20 also preferably includes rollers 42 and 44 which are mounted to housing 22 by bracket 46, and rollers 48 and 50, which are mounted to housing 22 by bracket 52. Rollers 42, 44, 48, 50 guide strands of web 12 past housing 22, so that sensing unit 20 does not interfere with travel of web 12 through loader/accumulator 10.

Figure 6:
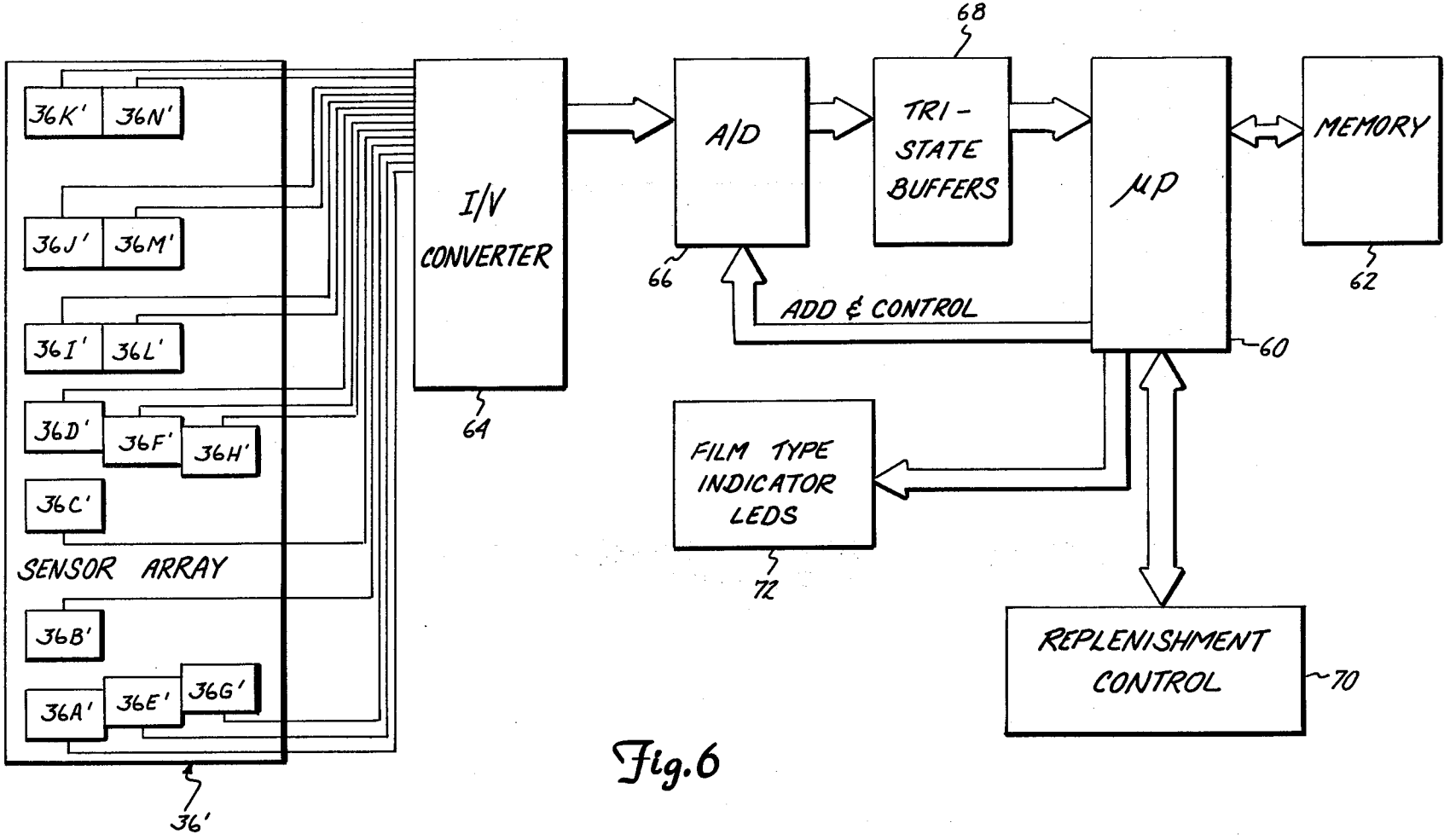
FIG. 6 is an electrical block diagram of the film type sensor of the present invention.

FIG. 6 is an electrical block diagram of a preferred embodiment of the film type sensor system of the present invention. In FIG. 6, sensor array 36' (which is used for sensing film types of up to 70 mm in width) is shown. In the event that sensor array 36 is used, the electrical system remains the same, except that sensor array 36 has fewer sensor modules than array 36' and therefore supplies fewer sensor output signals.

In the system shown in FIG. 6, microprocessor 60 determines film type based upon stored data contained in memory 62 and upon sensor output signals from array 36'. The sensor output signals produced by array 36' are in a form of individual analog electrical currents from the individual sensor modules 36A'–36N'. The currents are converted to analog voltages by current-to-voltage (I/V) convertor 64. The analog voltage signals are in turn converted to digital sensor signals by analog-to-digital (A/D) convertor 66. The digital sensor signals generated by A/D convertor 66 are supplied to microprocessor 60 by tri-state buffers 68.

Microprocessor 60 samples (or "polls") the digital sensor signals a number of times, and makes a determination of the film type based upon these repeated samplings. Based upon this determination, microprocessor 60 preferably provides replenishment control signals to replenishment control 70, which controls replenishment of each fluid then in use in the cine processor. In addition, microprocessor preferably actuates one of an array of film type indicator LEDs 72 corresponding to the identified film type. This provides a visual indication to the operator of the film type identified.

In one preferred embodiment of the present invention, memory 62 stores replenishment control information and is used to determine the amount of replenishment required for each solution required in the processing. A different set of replenishment control information is stored by memory 62 for each film type. Based upon its determination of the film type, microprocessor 60 provides the appropriate control signals to replenishment control 70.

In another embodiment of the present invention, replenishment control 70 has its own data storage capabilities. In this embodiment, microprocessor 60 merely provides an indication to replenishment control 70 of the film type that has been determined, and replenishment control 70 then provides the appropriate replenishment based upon its own stored replenishment information and the film type which has been identified by microprocessor 60.

The determination of film type by the film type sensor system of the present invention involves the sampling of the output signals of the individual sensor modules of sensor array 36' during a predetermined number of test cycles. The width of strand 12A is determined by summing the number of sensor modules of array 36' which have sensed the presence of strand 12A. Microprocessor 60 determines, for each width determining cycle, the particular film width based upon this sum and stores the result of this determination. By repeating the width determining cycle a predetermined number of times, microprocessor 60 obtains a more accurate indication of the width of strand 12A, since random fluctuations in the sensor output signals tend to be cancelled. Microprocessor 60 identifies strand 12A as having a particular width only if the same width determination is made in a predetermined percentage of the width determining cycles.

The width determination alone uniquely identifies 110 format film, 46 mm format film, 120/220 format film and 70 mm format film. In the case of 126 format film, 135 format film and film leader, all have a 35 mm width, and the width determination alone is not sufficient to uniquely identify film type.

In the event that the film is identified as having a 35 mm width, microprocessor 60 then performs a perforation sensing procedure. This procedure once again utilizes sensor output signals from array 36'. In this perforation sensing procedure, microprocessor 60 determines the presence of perforations along a first edge of strand 12A based upon signals from sensor modules 36A', 36E' and 36G' and along a second edge of strand 12A based upon signals from sensor modules 36D', 36F' and 36H'. This determination is made by sampling the sensor signals from these modules a number of times corresponding to a predetermined length of strand 12A (such as 0.4 inch). Within this distance, a perforation (if present) should be encountered and the sensor signals from the selected sensor module will exhibit a relatively large variation in value due to the different reflection between the film and the perforation.

Microprocessor 60 identifies web 12 as 135 format if perforations are determined to be present along both the first and second edges of strand 12A. Similarly, web 12 is identified as 126 format if perforations are determined to be present along only one of the two edges of strand 12A. If no perforations are present, web 12 is identified as a film leader.

Table 1 describes in detail the steps performed by microprocessor 60 during the width sensing and perforation portions of the film identification process. In the preferred embodiment described in Table 1, microprocessor 60 uses various counters during the procedure, and then makes film type identifications based on the values in these counters. Microprocessor 60 preferably uses selected memory locations within memory 62 as these counters, although alternatively separate hardware counters could be provided.

The procedure described in Table 1 is for sensing film types having widths up to 70 mm based on signals from sensor array 36'. If sensor array 36 is used, the same general steps are performed, escept that sensors 36I'–36N' are not present.

TABLE 1

| | |
|---|---|
| 1.0 | Width Sensing |
| 1.1 | Read in digital voltage value from sensor 36A'. |
| 1.2 | Compare digital sensor voltage with "ON" set-point voltage. If greater, update "Width Counter". If not, do not update. |
| 1.3 | Repeat steps 1.1 and 1.2 for sensors 36B', 36C', 36D' and 36I' through 36N'. |
| 1.4 | If Width Counter is equal to 1 or 2, update "110 Counter". If Width Counter is equal to 3 or 4, update "35mm Width Counter". If Width Counter is equal to 5 of 6, update "46mm Counter". If Width Counter is equal to 7 or 8, update "120/220 Counter". If Width Counter is equal to 9 or 10, update "70mm Counter". |
| 1.5 | Repeat steps 1.1 through 1.4 five times. If "110 Counter", "46mm Counter", "110/220 Counter" or "70mm Counter" is 4 or greater, light the corresponding film type indicator LED 72 for that film type and provide replenishment control signal to replenishment control 70 based upon this film type identification. If "35mm Width Counter" is 4 or greater, go to step 2.0 (Perforation Sensing). If no counter is 4 or greater, return to 1.0 and perform Width Sensing up to five times. If no counter is 4 or greater after five times through Width Sensing, then flag as error condition. |
| 2.0 | Perforation Sensing |
| 2.1 | Read in digital voltage value from sensor 36A' and store in both "High Value" and "Low Value" memory locations associated with sensor 36A'. |
| 2.2 | Repeat 2.1 for sensors 36D', 36E', 36F', 36G' and 36H'. |
| 2.3 | Read in the digital voltage value from sensor 36A' once again. Compare with "High Value"--if higher, make it the new "High Value". Compare with "Low Value"--if lower, make it the new "Low Value." |
| 2.4 | Repeat 2.3 for sensors 36D' through 36H'. |
| 2.5 | Repeat steps 2.3 and 2.4 a number of times corresponding to 0.4 inch of travel of strand 12A. The number of repetitions is determined by dividing a constant (e.g., 525) by the film speed in feet per minute. |
| 2.6 | Subtract "Low Value" from "High Value" for sensor 36A'. If greater than "Perforation Set Point", set "Sensor 36A'" flag. |
| 2.7 | Repeat 2.6 for sensors 36D' through 36H'. |
| 2.8 | Analyze Sensor 36A' and Sensor 36D' through Sensor 36H' flags. If Sensor 36A', Sensor 36E' or Sensor 36G' flag is set (i.e., have detected perforations), update "Side One Counter". If Sensor 36D', Sensor 36F' or Sensor 36H' flag is set, update "Side Two Counter". |
| 2.9 | Repeat steps 2.1 through 2.8 nine more times. (This corresponds with a total travel of 4 inches by strand |

TABLE 1-continued

| |
|---|
| 12A). If "Side One Counter" and "Side Two Counter" are both greater than 8, (i.e., 80% detection), identify web 12 as 135 format. If "Side One Counter" is between 3 and 8 and "Side Two Counter" is less than 3; or if "Side Two Counter" is between 3 and 8 and "Side One Counter" is less than 3, identify web 12 as 126 format. If "Side One Counter" and "Side Two Counter " are both less than 3, identify web 12 as leader. Provide the replenishment control signals to the replenishment control 70 based upon the degignated film type, and light the appropriate film type indicator LED 72. |

In conclusion, the present invention is a film type sensor which is effective in identifying a wide variety of different film types. This identification is made without physical contact with the image area of the emulsion on web 12. By sampling sensor signals over a number of successive cycles, the accuracy of identification is enhanced. Once the film type is identified, automatic replenishment of processor fluids in a cine processor is possible without requiring manual intervention by the operator when the film type entering the processor is changed.

Although the present invention has been described with reference to preferred embodiments, workers skilled in the art will recognize that changes may be made in form and detail without departing from the spirit and scope of the invention.

What is claimed is:

1. A photographic film type sensor apparatus for identifying a film web, the apparatus comprising:

an array of sensor means positioned across a path of the web, each sensor means sensing presence of the web adjacent the sensor means;

means for counting the number of sensor means which have sensed presence of the web during each of a plurality of width determining cycles;

means for making a width determination for each of the width determining cycles based upon the counted number of sensor means during the cycle; and means for identifying the web by film width based upon a total of the width determinations from the plurality of width determining cycles.

2. The apparatus of claim 1 and further comprising:

means for determining presence of perforations along first and second longitudinal edges of the web based upon signals from selected sensor means of the array; and means for identifying the film web as (1) 135 format if perforations are determined to be present along the first and second edges, (2) 126 format if perforations are determined to be present along only one of the first and second edges, and (3) film leader if perforations are determined to not be present.

3. The apparatus of claim 2 wherein the means for determining presence of perforations comprises:

means for sensing signal variations in the signals from the selected sensor means during each of a plurality of perforation sensing cycles;

means for providing a first count indicative of the number of perforation sensing cycles in which the signal variation from a sensor means along the first edge exceeds a predetermined value; and means for providing a second count indicative of the number of perforation sensing cycles in which the signal variation from a sensor means along the second edge exceeds the predetermined value.

4. The apparatus of claim 3 wherein the means for identifying the film web identifies the film web as 135 format if both the first and second counts exceed a predetermined count, identifies the film web as 126 format if only one of the first and second counts exceeds the predetermined count, and identifies the film web as film leader if neither of the first and second counts exceeds the predetermined count.

5. The apparatus of claim 1 wherein the sensor means are reflective infrared sensor means.

6. A photographic film type sensor apparatus for identifying a film web, the apparatus comprising:

first sensor means positioned adjacent a first longitudinal edge of the film web;

second sensor means positioned adjacent a second longitudinal edge of the web;

means for sensing signal variations in signals from the first and second sensor means during each of a plurality of perforation sensing cycles;

means for providing a first count indicative of the number of perforation sensing cycles in which the signal variation from the first sensor means exceeds a predetermined value;

means for providing a second count indicative of the number of perforation sensing cycles in which the signal variation from the second sensor means exceeds the predetermined value; and means for identifying the film web as a function of the first and second counts.

7. The apparatus of claim 6 wherein the means for identifying the film web identifies the film web as 135 format if the first and second counts exceed a predetermined count, identifies the film web as 126 format if only one of the first and second counts exceeds the predetermined count, and identifies the film web as film leader if neither of the first and second counts exceeds the predetermined count.

8. Apparatus for identifying an unprocessed photographic film web entering a photographic processor; the apparatus comprising:

an array of sensor means positioned generally across the path of the film web, each sensor means sensing presence of the web adjacent the sensor means; means for identifying the web by width as a function of the number of sensor means sensing presence of the web;

means for determining presence of perforations along first and second edges of the web based upon signals from the array of sensor means; and means for distinguishing between webs of similar width based upon the determination of whether perforations are present along the first and second edges of the web.

9. In a photographic processor, a sensor apparatus for identifying an unprocessed photographic film web entering the processor, sensor apparatus comprising:

an array of reflective infrared sensor means positioned across a path of the film web, each sensor means providing a sensor signal indicative of whether the film web is adjacent the sensor means; and means for identifying the film web as a function of the number of sensors providing sensor signals indicative of the film adjacent the sensor means and of whether selected sensor means of the array are providing signals indicating the presence of perforations in the film web.

10. A method of identifying an unprocessed photographic film web entering a photographic processor based upon signals from a plurality of sensors positioned in an array generally transverse to direction of travel of the film web prior to entering the film processor, the method comprising:

counting the number of sensors which detected the presence of film web during a film width determining cycle;

making a film width determination from a selected group as a function of the counted number;

repeating the counting and determining steps for a selected number of width determining cycles; and identifying the film web by film width based upon a total of the film width determinations made during a selected number of film width determination cycles.

11. The method of claim 10 and further comprising:

performing a plurality of perforation sensing cycles to determine presence of perforations along first and second longitudinal edges of the film web based upon signals from selected sensors of the array if the film web has been identified as having a film width of 35 mm;

identifying the film web as 135 format if perforations are determined to be present along the first and second edges;

identifying the film web as 126 format if perforations are determined to be present along only one of the first and second edges; and identifying the film web as film leader if perforations are determined not to be present.

12. The method of claim 11 wherein performing a plurality of perforation sensing cycles comprises:

sensing signal variations in signals from the selected sensors during each of a plurality of perforation sensing cycles;

providing a first count indicative of the number of perforation sensing cycles in which the signal variation from a sensor along the first edge of the web exceeds a predetermined value; and providing a second count indicative of the number of perforation sensing cycles in which the signal variation from a sensor along the second edge of the web exceeds the predetermined value.

13. Photographic film type sensor apparatus for identifying a photographic film web from among a group including 110 format, 126 format, 135 format, and film leader, the apparatus comprising:

an array of reflective infrared sensor means positioned across a path of the film, each sensor means sensing presence of the film adjacent the sensor means;

width counter means for providing a width count during each of a plurality of width determining cycles, indicative of a number of the sensor means of the array which have sensed presence of film;

110 counter means for providing a 110 format count;

35 mm width counter means for providing a 35 mm width count;

means for updating the 110 count for each width determining cycle in which the width count is in a first predetermined range, and updating the 35 mm width count for each width determining cycle in which the width count is in a second predetermined range;

means for identifying the film web as 110 format if the 110 count has attained a predetermined value after a selected number of width determining cycles, and for identifying the film web as having a 35 mm width if the 35 mm width count has attained a predetermined value after the selected number of width determining cycles;

means for determining presence of perforations along first and second edges of the film web based upon signals from selected sensors of the array, if the film web has been identified as having a 35 mm width; and means for identifying the film web as 135 format if perforations are determined to be present along both the first and second edges, identifying the film web as 126 format if perforations are determined to be present along only one of the first and second edges, and identifying the film web as film leader if perforations are not present along the first and second edges.

14. For use with a photographic processor of photographic film webs having a emulsion side and a non-emulsion side, a film type sensor apparatus for identifying an unprocessed film web traveling along a path prior to entering the processor, the apparatus comprising:

a first hour glass roller for engaging the emulsion side of the web only at longitudinal edges of the web;

a first cylindrical roller for receiving the web from the first hour glass roller and engaging the non-emulsion side of the web;

a second cylindrical roller for receiving the web from the first cylindrical roller and engaging the non-emulsion side of the web;

a second hour glass roller for receiving the web from the second cylindrical roller and engaging the emulsion side of the web only at longitudinal edges of the web;

an array of infrared reflective sensor means positioned along the path of the web at a position between the first and second cylindrical roller means and adjacent the emulsion side of the web; and signal processor means for identifying the web by film type based upon signals from the array of reflective infrared sensor means.

15. In a photographic processor of the type having a loader/accumulator with a set of upper roller and a set of lower rollers which define a serpentine helical path of an unprocessed photographic film web between the upper and lower sets of rollers, and in which a final strand of the web passes under a final lower roller, travels upward from the final lower roller to a final upper roller, and travels over the final upper roller and then into the processor for photoprocessing, apparatus for identifying the unprocessed film web entering the processor by film type, and the apparatus comprising:

an array of reflective infrared sensor means positioned along the path of the final strand of the web between the final lower roller and the final upper roller, the array of reflective infrared sensor means being positioned generally transverse to the path of the web, each sensor means sensing presence of film adjacent the sensor means; and signal processing means for receiving signals from the array of reflective infrared sensor means and determining film type based upon the signals from the array.

16. The apparatus of claim 15 and further comprising:

a first hour glass roller positioned along the path of the final strand of the web for receiving the web from the final lower roller and for engaging an emulsion side of the web only at longitudinal edges of the web;

a first cylindrical roller for receiving the web from the first hour glass roller and engaging a non-emulsion side of the web;

a second cylindrical roller for receiving the web from the first cylindrical roller and engaging the non-emulsion side of the web;

a second hour glass roller for receiving the web from the second cylindrical roller and engaging the emulsion side of the web only at longitudinal edges of the web, wherein the web travels from the second hour glass roller to the final upper roller of the loader/accumulator, and wherein the array of reflective infrared sensor means is positioned along the path of the final strand of the web between the first and second cylindrical roller means.

17. The apparatus of claim 16 wherein the array of reflective infrared sensor means is positioned adjacent the emulsion side of the web.

* * * * *